US007795567B2

(12) United States Patent
Schneider

(10) Patent No.: US 7,795,567 B2
(45) Date of Patent: Sep. 14, 2010

(54) GUIDED KINETIC PENETRATOR

(75) Inventor: Arthur J. Schneider, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 1193 days.

(21) Appl. No.: 11/100,243

(22) Filed: Apr. 5, 2005

(65) Prior Publication Data

US 2006/0219839 A1 Oct. 5, 2006

(51) Int. Cl.
*F42B 10/12* (2006.01)

(52) U.S. Cl. ..... 244/3.26; 244/3.24; 102/522; 102/517

(58) Field of Classification Search ..... 244/3.14, 244/3.15, 3.24, 3.25, 3.26; 102/517, 518, 102/519, 520, 522; 340/870.06
See application file for complete search history.

(56) References Cited

U.S. PATENT DOCUMENTS 3,790,103 A * 2/1974 Peoples ..... 244/3.23
3,935,817 A * 2/1976 Riparbelli ..... 102/374
4,579,298 A * 4/1986 Thomson ..... 244/3.21
4,628,821 A * 12/1986 Madderra et al. ..... 102/517
4,697,525 A * 10/1987 Bocker et al. ..... 102/518
4,708,304 A * 11/1987 Wedertz et al. ..... 244/3.26
H403 H * 1/1988 Glasser ..... 102/374
4,730,561 A * 3/1988 Schaake ..... 102/517
4,815,682 A * 3/1989 Feldmann et al. ..... 244/3.23
5,014,931 A * 5/1991 Mikhail ..... 244/3.25
5,063,855 A 11/1991 Diel et al.
5,109,774 A * 5/1992 Deffayet ..... 102/382
5,155,295 A * 10/1992 Campoli ..... 102/430
5,158,509 A 10/1992 Ebaugh et al.
5,223,667 A 6/1993 Anderson
5,238,204 A * 8/1993 Metz ..... 244/3.15
5,440,993 A * 8/1995 Osofsky ..... 102/374
5,596,166 A * 1/1997 Gould ..... 102/362
5,685,504 A * 11/1997 Schneider et al. ..... 244/3.11
5,775,636 A * 7/1998 Vig et al. ..... 244/3.24
5,788,180 A * 8/1998 Sallee et al. ..... 244/3.21
5,917,442 A * 6/1999 Manoogian ..... 342/62
6,016,990 A * 1/2000 Small ..... 244/3.11
6,237,496 B1 * 5/2001 Abbott ..... 102/384
6,276,277 B1 * 8/2001 Schmacker ..... 102/384
6,494,140 B1 * 12/2002 Webster ..... 102/374
6,598,535 B1 * 7/2003 Kielsmeier et al. ..... 102/518
6,614,012 B2 9/2003 Schneider et al.
6,637,699 B2 * 10/2003 Banks et al. ..... 244/3.21
6,647,889 B1 * 11/2003 Biserød ..... 102/489
6,845,718 B2 * 1/2005 Fortner et al. ..... 102/518
7,023,380 B2 * 4/2006 Schneider ..... 342/361
2004/0231552 A1 * 11/2004 Mayersak ..... 102/519
2004/0244631 A1 * 12/2004 Eches et al. ..... 102/521

* cited by examiner

*Primary Examiner*—Benjamin P Lee
(74) *Attorney, Agent, or Firm*—The Noblitt Group, PLLC

(57) ABSTRACT

The disclosed system, device and method for guiding a hypersonic kinetic penetrator projectile (300) generally includes a kinetic penetrator body (110, 230) and a slip-over electronic guidance unit (120, 220), where the kinetic penetrator body slidably mounts through the slip-over electronic guidance unit. Disclosed features and specifications may be variously controlled, adapted or otherwise optionally modified to improve accuracy and control of a hypersonic projectile. Exemplary embodiments of the present invention generally provide multi-use slip-over electronic guidance units for hypersonic kinetic penetrator projectiles in 105 mm and 120 mm munition rounds, surface-to-surface missiles, and air-to-surface missiles.

16 Claims, 2 Drawing Sheets

GUIDED KINETIC PENETRATOR

FIELD OF INVENTION

The present invention generally concerns kinetic energy projectiles; and more particularly, representative and exemplary embodiments of the present invention generally relate to multi-use electronic guidance units for rockets and munitions.

BACKGROUND OF INVENTION

It has been demonstrated that a hardened long-rod penetrator delivering in excess of 5 megajoules of energy at hypersonic velocity to the armor of a tank can penetrate the armor and destroy the tank. This generally involves boosting the rod to hypersonic velocity using a gun-launched munition or a rocket motor.

Increased deployment of gun-launched and rocket-launched ordinance has resulted in their application to a wider variety of targets, which in turn has resulted in the production of different types of munitions and rockets adapted to carry kinetic penetrator rods. The different types of munitions and rockets required to defeat a variety of targets generally increases the need for producing and maintaining a large inventory of munitions and missiles.

Because they are unguided, gun-launched munitions that include kinetic penetrator rods are generally effective at relatively short ranges. Accurate guidance may extend the effective range of these gun-launched munitions. Rocket-launched missiles, such as direct fire missiles, may include kinetic penetrator rods and have a range in excess of gun-launched munitions.

Measurement of roll angle is generally required for projectile guidance in either gun-launched or rocket-launched ordinance; however, launch acceleration forces experienced by the projectile may damage conventional inertial measurement guidance systems. Various methods of measuring roll angle using solid-state electronics capable of withstanding launch acceleration have been previously demonstrated.

A guidance system for use in both gun-launched munitions and rocket-launched missiles suitably configured to deliver kinetic energy projectiles would be desirable. This would result in greater mission flexibility and reduced inventory for guided kinetic penetrator projectiles.

SUMMARY OF THE INVENTION

In various representative aspects, the present invention provides a system, device and method for guiding a hypersonic kinetic energy projectile. Exemplary features generally include a kinetic penetrator body and a slip-over electronic guidance unit, where the penetrator body slidably engages the slip-over electronic guidance unit.

Advantages of the present invention will be set forth in the Detailed Description which follows and may be apparent from the Detailed Description or may be learned by practice of exemplary embodiments of the invention. Still other advantages of the invention may be realized by means of any of the instrumentalities, methods or combinations particularly pointed out in the Claims.

BRIEF DESCRIPTION OF THE DRAWINGS

Representative elements, operational features, applications and/or advantages of the present invention reside inter alia in the details of construction and operation as more fully hereafter depicted, described and claimed—reference being made to the accompanying drawings forming a part hereof, wherein like numerals refer to like parts throughout. Other elements, operational features, applications and/or advantages will become apparent in light of certain exemplary embodiments recited in the Detailed Description, wherein:

Elements in the Figures are illustrated for simplicity and clarity and have not necessarily been drawn to scale. For example, the dimensions of some of the elements in the Figures may be exaggerated relative to other elements to help improve understanding of various embodiments of the present invention. Furthermore, the terms "first", "second", and the like herein, if any, are used inter alia for distinguishing between similar elements and not necessarily for describing a sequential or chronological order. Moreover, the terms "front", "back", "top", "bottom", "over", "under", and the like in the Description and/or in the Claims, if any, are generally employed for descriptive purposes and not necessarily for comprehensively describing exclusive relative position. Any of the preceding terms so used may be interchanged under appropriate circumstances such that various embodiments of the invention described herein may be capable of operation in other configurations and/or orientations than those explicitly illustrated or otherwise described.

DETAILED DESCRIPTION OF EXEMPLARY EMBODIMENTS

The following representative descriptions of the present invention generally relate to exemplary embodiments and the inventor's conception of the best mode, and are not intended to limit the applicability or configuration of the invention in any way. Rather, the following description is intended to provide convenient illustrations for implementing various embodiments of the invention. As will become apparent, changes may be made in the function and/or arrangement of any of the elements described in the disclosed exemplary embodiments without departing from the spirit and scope of the invention.

Various representative implementations of the present invention may be applied to any system for a kinetic energy projectile guidance system. Certain representative implementations may include, for example: gun-launched munitions having a kinetic energy projectile; rocket-launched missiles having a kinetic energy projectile; and/or the like. A detailed description of an exemplary application, namely a kinetic energy projectile guidance system, is provided as a specific enabling disclosure that may be generalized to any application of the disclosed system, device and method for projectile guidance in accordance with various embodiments of the present invention.

Figure 1:
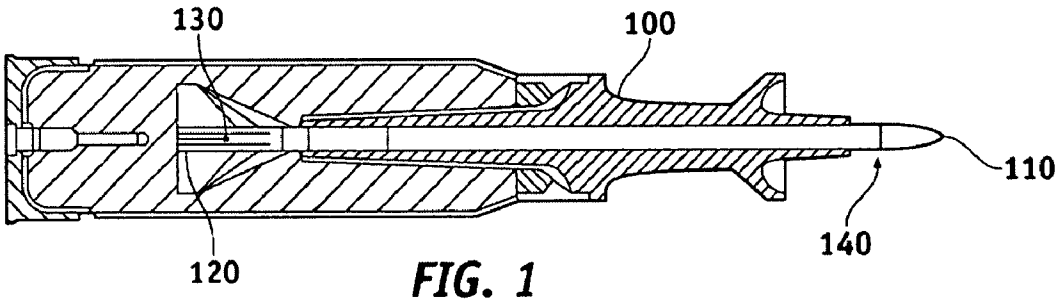
FIG. 1 representatively illustrates a side cross-sectional view of a munition round in accordance with an exemplary embodiment of the present invention.

FIG. 1 representatively illustrates a side cross-sectional view of a munition round 100 in accordance with an exemplary embodiment of the present invention. Munition round 100 may be configured for deployment from a gun, such as a cannon, and may comprise, for example a sabot munition round. Munition round 100 may also include kinetic penetrator body 110 and slip-over electronic guidance unit 120 both housed substantially within munition round 100. In an exemplary munitions embodiment, such as a sabot round, kinetic penetrator body 110 may be generally smaller than the bore of the gun firing the munition round. The sabot shroud generally fits around the kinetic penetrator body 110, allowing it to be safely fired from the gun. Engagement of the slip-over electronic guidance unit 120 to the kinetic penetrator body 110 may be accelerated during propellant burn of the munition 100. After firing, the sabot generally falls away leaving the kinetic penetrator body 110 (with the slip-over electronic guidance unit 120 slidably engaged) continuing on toward the target. The relatively small diameter of the penetrator body 110 concentrates kinetic energy on a relatively small portion of the target, thereby increasing the probability of penetrating the target.

In an exemplary embodiment, kinetic penetrator body 110 may include a substantially cylindrical rod-like structure comprising a hardened material comprising, for example: tungsten; carbide steel; depleted uranium; and/or the like. Alternatively, conjunctively, or sequentially, one end of kinetic penetrator 110 may be aerodynamically shaped to provide a high ballistic coefficient. In another exemplary embodiment in accordance with the present invention, slip-over guidance unit 120 may include a substantially hollow cylindrical finned structure suitably adapted to receive kinetic penetrator body 110 as described in greater detail vide infra.

Figure 2:
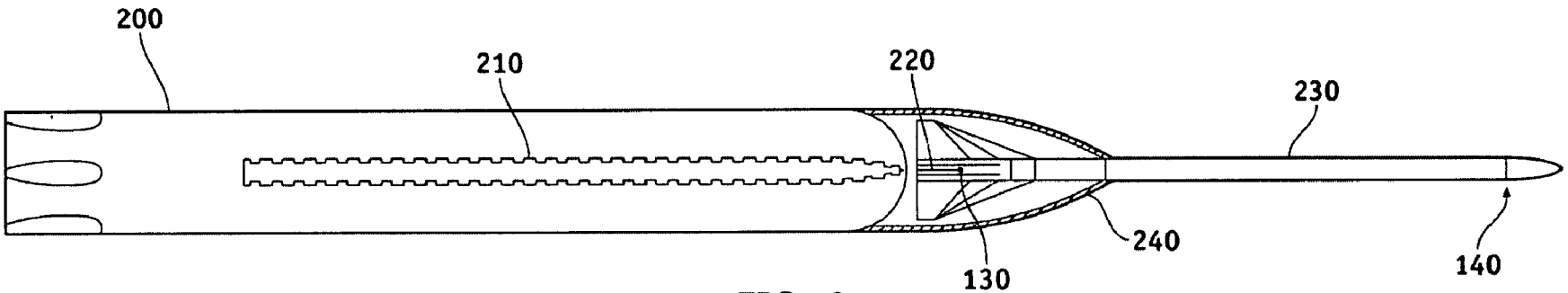
FIG. 2 representatively illustrates a side cross-sectional view of a rocket motor assembly having a kinetic penetrator body in accordance with an exemplary embodiment of the present invention.

FIG. 2 representatively illustrates a side cross-sectional view of a rocket motor assembly 200 having a kinetic penetrator body 230 in accordance with an exemplary embodiment of the present invention. One example utilizes a diameter substantially compatible with the TOW missile so that it may be launched from existing TOW missile launchers. Rocket motor assembly 200 may be included in a missile, such as a surface-to-surface or air-to surface cruise missile, and/or the like. Rocket motor assembly 200 may include a forward payload section and an aft section. Aft section may comprise components that are conventional utilized for a rocket motor assembly 200 such as, for example, jet engines, fuel, rocket motors, guidance and communications equipment, aerodynamic stabilization or control surfaces (e.g., such as fins or canards), and/or the like. Aft section may also include a penetrator body storage cavity 210 for storing kinetic penetrator body 230 for transportation.

Forward payload section may include, for example, payload items such as munitions, fuel and the like. In another representative embodiment, forward payload section may further include slip-over electronic guidance unit 220. In yet another exemplary embodiment, slip-over guidance unit 220 may include a substantially hollow cylindrical finned structure suitably adapted to receive kinetic penetrator body 230. The nose portion of forward payload section may include slots 240 to accommodate fins of slip-over electronic guidance unit 220.

In still another exemplary embodiment, slip-over electronic guidance unit 220 may be stored in forward payload section of rocket motor assembly 200 during transit. Prior to launch, kinetic penetrator body 230 may be moved forward, through slip-over electronic guidance unit 220 to engage with slip-over electronic guidance unit 220. In such a configuration, kinetic penetrator body 230 and slip-over electronic guidance unit 220 may be disposed in a manner similar to that shown and described in FIG. 1 with reference to munition round 100. The rocket motor assembly 200 may be boosted to a hypersonic velocity and thereafter burned out. Engagement of slip-over guidance unit 220 may be tightened during propellant burn of the rocket motor assembly 200. The nose portion of the forward payload section may be configured to permit kinetic penetrator body 230 and slip-over electronic guidance unit 220 (together comprising a hypersonic kinetic penetrator projectile) to separate, be command guided and strike the target with hypersonic velocity.

Figure 3:
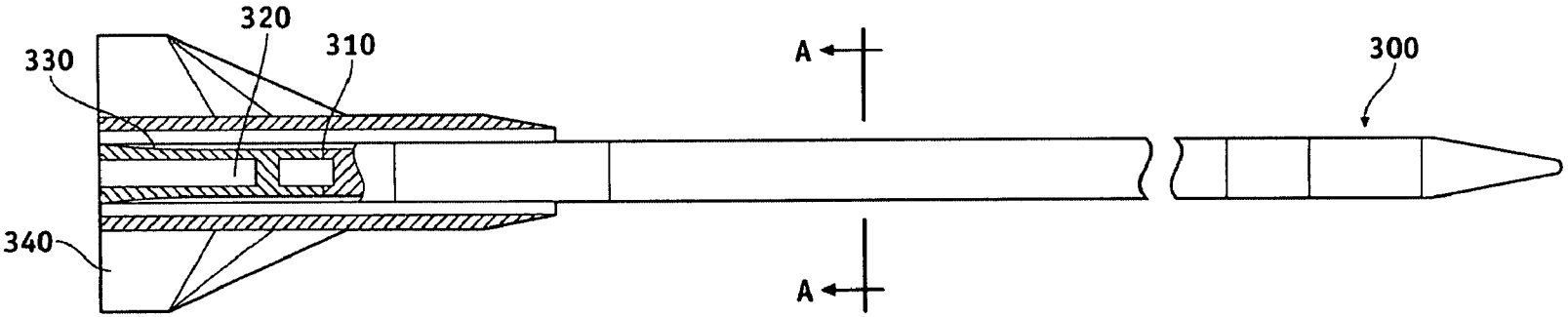
FIG. 3 representatively illustrates a side cross-sectional view of a hypersonic kinetic penetrator projectile in accordance with an exemplary embodiment of the present invention.

FIG. 3 representatively illustrates a side cross-sectional view of a hypersonic kinetic penetrator projectile 300 in accordance with an exemplary embodiment of the present invention. Hypersonic kinetic penetrator projectile 300 may include kinetic penetrator body and slip-over guidance unit as shown and generally described with reference to FIGS. 1 and 2. Slip-over guidance unit may be a substantially hollow cylindrical finned structure suitably adapted to receive kinetic penetrator body.

Kinetic penetrator body may slide forward though slip-over electronic guidance unit and engage via locking taper 330. Slip-over electronic guidance unit may have an inner diameter suitably adapted for slidable engagement over the front portion of kinetic penetrator body. In a representative and exemplary application, the penetrator body generally slides 'nose first' though slip-over guidance unit during factory assembly of a gun cartridge or just prior to firing a rocket boosted rod.

In another embodiment of the present invention, locking taper 330 may comprise a rear portion of kinetic penetrator body that increases or decreases in outer diameter around its circumference from front to back such that the outer diameter is larger or smaller in the rear portion and tapers to a smaller or flares to a larger outer diameter forward. Since the rear portion of penetrator body will generally have a larger or smaller rear diameter than the front portion, slip-over electronic guidance unit will engage the larger or smaller outer diameter rear portion of kinetic penetrator body, i.e. locking taper 330. Such a configuration generally prevents slip-over electronic guidance unit from disengaging kinetic penetrator body when the hypersonic kinetic penetrator projectile 300 is accelerated in forward motion. The angle or rate of taper or flare is not limiting of the invention and any angle or rate of taper or flare is generally considered to be within the scope of the present invention.

In yet another embodiment of the present invention, the kinetic penetrator body and the slip-over guidance unit may have a locking taper 330. In still another embodiment, the kinetic penetrator body and the slip-over guidance unit may each have a locking taper 330. Where each have a locking taper 330, the angle or rate of taper or flare may substantially match the corresponding seat so that a substantially snug fit may be obtained between the kinetic penetrator body and the slip-over guidance unit.

In yet another exemplary embodiment in accordance with the present invention, locking taper 330 may comprise a flare projection on a rear portion of kinetic penetrator body such that when slip-over guidance unit is slidably engaged from the forward end of kinetic penetrator body, the guidance unit engages on the flare projection. Flare projection may be, for example, a substantially abrupt change in outer diameter of kinetic penetrator body or one or more radially projecting mounts on the end of kinetic penetrator body, and/or the like. Any mechanism for engaging slip-over electronic guidance unit on the rear portion of kinetic penetrator body may be alternatively, conjunctively or sequentially employed and will generally be considered to be within the scope of the present invention.

The rear portion of kinetic penetrator body may include a power source 310 and a tracer 320. Power source 310 may comprise a battery that may be used inter alia to initiate tracer 320. Tracer 320 may comprise a chemical tracer, such that hypersonic kinetic penetrator projectile 300 may be generally visibly tracked during flight. Tracer 320 may also comprise an electronic tracer utilizing, for example, radio frequency or infrared elements such that hypersonic penetrator projectile may be tracked visibly or electronically. In yet another exemplary embodiment, slip-over electronic guidance unit may include fins 340 suitably adapted to generally maintain a predetermined roll rate throughout the flight to the target.

Figure 4:
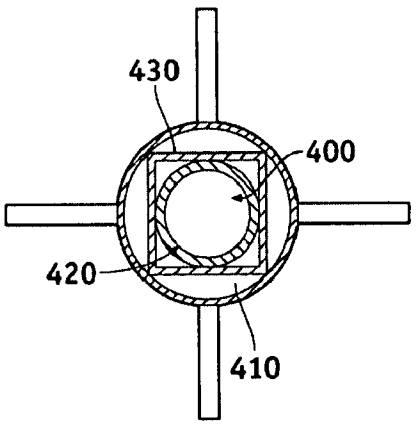
FIG. 4 representatively illustrates a lateral cross-sectional view of a hypersonic kinetic penetrator projectile in accordance with an exemplary embodiment of the present invention.

FIG. 4 representatively illustrates a lateral cross-sectional view of a hypersonic kinetic penetrator projectile in accordance with an exemplary embodiment of the present invention. As representatively illustrated for example in FIG. 4, hypersonic kinetic penetrator projectile generally includes kinetic penetrator body 400, kinetic penetrator body nose 420, fin body 410 and computer board 430. Fin body 410 may be a portion of slip-over electronic guidance unit suitably adapted to provide fins to hypersonic kinetic penetrator projectile. Computer board 430 may include guidance electronics such as a processor, a memory, an antenna, a transmitter, a receiver, a millimeter wave length wave emitter, and/or the like to provide telemetry and receive guidance instructions from a receiver system located, for example, substantially remotely disposed from hypersonic kinetic penetrator projectile.

As noted vide supra, a substantially identical kinetic penetrator body and slip-over electronic guidance unit may be utilized in either a gun-launched munition round or a rocket motor assembly of a missile. In either case, hypersonic kinetic penetrator projectile may be accelerated to hypersonic velocity (e.g., in excess of mach 5) and separated from either the munition round or rocket motor assembly. In both cases, the projectile may be given a roll rate to average out any aerodynamic or thrust misalignments. For example, the gun firing the munition round may be rifled to induce spin in the munition round, or the rocket motor nozzles/fins may be curved so as to induce a roll rate during the boost phase of launch.

In an exemplary application in accordance with a representative embodiment of the present invention, the system may be adapted to include a launch vehicle subsystem and a projectile subsystem. The launch vehicle subsystem may comprise a Forward Looking Infra-red (FLIR) camera and a laser range finder to track and identify a target as well as to calculate target azimuth, elevation and range information. The launch vehicle subsystem may further comprise a transmitter, which radiates, for example, millimeter wave energy to the projectile subsystem (i.e., hypersonic kinetic penetrator projectile) via a first antenna. Return signals from the projectile subsystem may be received by a second antenna, implemented, for example, in a phased array of polarized monopulse antenna elements, and passed to a receiver/computer. The receiver/computer may be suitably configured to compute projectile roll angle in accordance with the system generally disclosed in U.S. Pat. No. 6,016,990 entitled ALL-WEATHER ROLL ANGLE MEASUREMENT FOR PROJECTILES, Issued on Jan. 25, 2000 to James G. Small.

Hypersonic kinetic penetrator projectile may include at least one of a divert charge 130 mounted on the slip-over guidance unit or a substantially moveable nose cone 140 mounted on the kinetic penetrator body to perform target acquisition course correction during flight. The divert charge 130 or the substantially moveable nose 140 may be actuated via at least one of a radio frequency (RF) or a wired connection. Control signals to actuate either the divert charge 130 or the moveable nose 140 may be communicated or processed by, for example, the slip-over electronic guidance unit.

The slip-over electronic guidance unit of hypersonic kinetic penetrator projectile may include a continuous wave transmitter, an antenna system and a command receiver. The transmitter and receiver may be adapted to share the antenna system, although separate transmit and receive antennas may be employed in other alternative, conjunctive or sequential embodiments.

The transmit system employed in slip-over electronic guidance unit may be a linearly polarized transmit antenna system. In such an embodiment, a first transmitter may be configured to transmit a first transmit signal at a first frequency, while a second transmitter may be configured to transmit a second transmit signal at a second frequency. While first frequency and second frequency are generally different, first transmit signal and second transmit signal are generally in phase coherence.

A receiver system may be generally located at a ground launch vehicle site or in an aerial vehicle remotely disposed away from the hypersonic kinetic penetrator. The receiver system may include a linearly polarized receive antenna for receiving a first transmit signal and a second transmit signal. Both signals may be down-converted via a receiver section to a first receiver signal and a second receiver signal respectively, where first and second receiver signals are generally in phase coherence. The receiver system may also include a roll angle processor for processing first and second receiver signals to calculate roll angle of the kinetic penetrator projectile.

A command transmitter, optionally located with receiver system, may transmit course correction commands to slip-over guidance unit to effect target acquisition course correction using, for example, a real-time data link. The slip-over electronic guidance unit may actuate at least one of movement of moveable nose cone 140 or firing of at least one divert charge 130 based on received course correction data via at least one of an RF link or a wired communication link.

In yet another embodiment, receivers on slip-over electronic guidance unit of hypersonic kinetic penetrator projectile may be disposed to receive two substantially coherent linearly polarized signals from a remote receiver system in a radio line-of-sight of hypersonic kinetic penetrator projectile. Slip-over electronic guidance unit may include a GPS receiver for the determination of position. By receiving signals from remote receiver system, hypersonic kinetic penetrator projectile may determine its rotation angle relative to the direction of linear polarization of the transmitted signals. Hypersonic kinetic penetrator projectile may thereafter initiate target acquisition course correction through actuating at least one of movement of moveable nose cone 140 or firing of at least one divert charge 130.

The remote receiver system may guide a line-of-sight impact by tracking an emitter on slip-over electronic guidance unit of hypersonic kinetic penetrator projectile in a substantially similar field of view as the target being tracked. In such an embodiment, where an FLIR and laser range finder may be used to identify and track the target, an offset trajectory may be used for deployment of the hypersonic kinetic penetrator projectile so as not to obscure the line-of-sight field of view to the target.

The foregoing system generally has the advantage of increasing accuracy to the order of 0.1 milliradians, corresponding to a deviation of not more than 0.5 meters at a range of 5 kilometers. The probability of a hit on a target is substantially above 90%, while the miss distance for an unguided kinetic penetrator body is generally ten times greater. The slip-over electronic guidance unit may be used on a variety of ordinance platforms including gun-launched munitions and rocket-launched missiles that use a kinetic penetrator body. The disclosed system is capable of withstanding in excess of 70,000 g's of launch acceleration force. The disclosed system also simplifies logistics by effectively reducing the need for multiple launch systems, thereby substantially reducing costs.

In the foregoing specification, the invention has been described with reference to specific exemplary embodiments; however, it will be appreciated that various modifications and changes may be made without departing from the scope of the present invention as set forth in the Claims below. The specification and figures are to be regarded in an illustrative manner, rather than a restrictive one and all such modifications are intended to be included within the scope of the present invention. Accordingly, the scope of the invention should be determined by the Claims appended hereto and their legal equivalents rather than by merely the examples described above.

For example, the steps recited in any method or process claims may be executed in any order and are not limited to the specific order presented in the Claims. Additionally, the components and/or elements recited in any apparatus claims may be assembled or otherwise operationally configured in a variety of permutations to produce substantially the same result as the present invention and are accordingly not limited to the specific configuration recited in the Claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the Claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

I claim:

1. A projectile guidance system, comprising:

a detachable launch system defining an inner volume;

a kinetic penetrator body at least partially enclosed within the inner volume of the detachable launch system; and a controllable slip-over guidance unit approximately forming a cylinder open on both ends, wherein: the slip-over guidance unit is enclosed within the inner volume of the detachable launch system, and the kinetic energy penetrator body longitudinally slidably mounts to the slip-over guidance unit through the cylinder, wherein exterior surface portion of the kinetic energy penetrator body engages an inner surface of the cylinder before the projectile is launched.

2. The projectile guidance system of claim 1, wherein the controllable slip-over guidance unit engages with the kinetic penetrator body via at least one of a taper and a flare.

3. The projectile guidance system of claim 1, wherein:

the controllable slip-over guidance unit is stored in a forward portion of a rocket motor assembly; and the kinetic penetrator body is stored within an aft portion of the rocket motor assembly and is adapted to be slidably repositioned from the aft portion of the rocket motor assembly to the forward portion of the rocket motor assembly to engage the controllable slip-over guidance unit before launch.

4. The projectile guidance system of claim 1, wherein the controllable slip-over guidance unit comprises a transmit system, the transmit system comprising a linearly polarized transmit antenna system, a first transmitter coupled to the transmit antenna system for transmitting a first transmit signal at a first frequency, a second transmitter coupled to the transmit antenna system for transmitting a second transmit signal at a second frequency, wherein the first frequency is different from the second frequency, and the first transmit signal and the second transmit signal are in phase coherence.

5. The projectile guidance system of claim 1, wherein the system includes at least one of a divert charge mounted on the controllable slip-over guidance unit and a substantially moveable nose mounted on the kinetic penetrator body, wherein the movable nose is configured to pivot relative to the kinetic penetrator body.

6. The projectile guidance system of claim 5, wherein at least one of the moveable nose and the divert charge is actuated via at least one of a wireless and a wired communication.

7. The projectile guidance system of claim 6, wherein control signals are at least one of communicated from and processed by the controllable slip-over guidance unit.

8. The projectile guidance system of claim 1, wherein a millimeter wavelength wave emitter is carried in a rear portion of kinetic penetrator body.

9. The projectile guidance system of claim 1, wherein the kinetic penetrator body comprises at least one of tungsten, carbide steel, and depleted uranium.

10. The projectile guidance system of claim 1, wherein the kinetic penetrator body and the controllable slip-over electronic guidance unit are adapted for interchangeable placement inside of detachable launch systems of varying diameters.

11. The projectile guidance system of claim 10, wherein the varying diameters comprise a munition round of a first diameter and a rocket motor assembly of a second diameter.

12. A kinetic energy projectile device, comprising:

a detachable exterior shell;

a controllable slip-over electronic guidance unit forming a cylinder open on both ends with an inner surface, wherein the controllable slip-over electronic guidance unit is enclosed within the detachable exterior shell;

a kinetic penetrator body disposed at least partially within the detachable exterior shell, wherein:

the kinetic penetrator body longitudinally slidably mounts to the controllable slip-over electronic guidance unit through the cylinder of the controllable slip-over electronic guidance unit prior to the kinetic energy projectile device launching; and the controllable slip-over electronic guidance unit engages with the kinetic penetrator body via at least one of a locking taper and a flare; and at least one of a divert charge disposed on the controllable slip-over electronic guidance unit and a substantially moveable nose disposed on the kinetic penetrator body, wherein the moveable nose is configured to pivot relative to the kinetic penetrator body.

13. The kinetic energy projectile device of claim 12, wherein controllable slip-over electronic guidance unit comprises a transmit system, the transmit system comprising a linearly polarized transmit antenna system, a first transmitter coupled to the transmit antenna system for transmitting a first transmit signal at a first frequency, a second transmitter coupled to the transmit antenna system for transmitting a second transmit signal at a second frequency, wherein the first frequency is different from the second frequency, and the first transmit signal and the second transmit signal are in phase coherency.

14. The kinetic energy projectile device of claim 12, wherein the controllable slip-over electronic guidance unit further comprises a millimeter wavelength wave emitter.

15. The kinetic energy projectile device of claim 12, wherein the kinetic penetrator body and the controllable slip-over electronic guidance unit are adapted for interchangeable placement inside of detachable exterior shells of varying diameters.

16. The kinetic energy projectile device of claim 15, wherein the varying diameters comprise a munition round of a first diameter and a rocket motor assembly of a second diameter.

* * * * *